United States Patent [19]

Hummel

[11] 4,433,781

[45] Feb. 28, 1984

[54] COMPACT DUAL BELL SECTION TROMBONE CASE

[76] Inventor: Donald A. Hummel, P.O. Box 1329, Wickenburg, Ariz. 85358

[21] Appl. No.: 424,640

[22] Filed: Sep. 27, 1982

[51] Int. Cl.[3] ..... A45C 11/00

[52] U.S. Cl. ..... 206/314; 206/14; 206/523; 206/592

[58] Field of Search ..... 206/14, 314, 349, 523, 206/316, 521, 592, 593, 594; 190/39, 12, 57

[56] References Cited

U.S. PATENT DOCUMENTS

| | | | |
|---|---|---|---|
| 270,640 | 1/1883 | Cundy | 206/314 |
| 1,541,895 | 6/1925 | Blair | 206/14 |
| 3,048,262 | 8/1962 | Pascucci | 206/314 |
| 3,241,661 | 3/1966 | Zamzow et al. | 206/523 |
| 3,637,070 | 1/1972 | Friedman | 206/314 |
| 3,811,562 | 5/1974 | Smith | 206/523 |
| 3,901,384 | 8/1975 | Lee et al. | 206/523 |
| 4,009,781 | 3/1977 | Agnew et al. | 206/523 |
| 4,093,010 | 6/1978 | Hunley et al. | 206/523 |

FOREIGN PATENT DOCUMENTS

| | | | |
|---|---|---|---|
| 1451468 | 6/1965 | France | 206/314 |
| 21582 | of 1892 | United Kingdom | 190/39 |
| 856558 | 12/1960 | United Kingdom | 206/523 |

*Primary Examiner*—Joseph Man-Fu Moy
*Assistant Examiner*—David T. Fidei
*Attorney, Agent, or Firm*—Cahill, Sutton & Thomas

[57] ABSTRACT

A compact tenor trombone case for carrying a "single" B-flat bell section, a bell section with F attachment, and a slide section that mates with either of the bell sections includes first and second triangular padded bell section compartments separated by an inclined wall section with an elongated padded groove therein for holding the slide section. The first triangular compartment holds the bell section with the F attachment and the second triangular compartment holds the "single" B-flat bell section. The trombone case enables a trombonist to carry the trombone components needed to play either a "single" B-flat trombone or a B-flat trombone with F attachment in a unitary compact case.

12 Claims, 7 Drawing Figures

FIG. 1
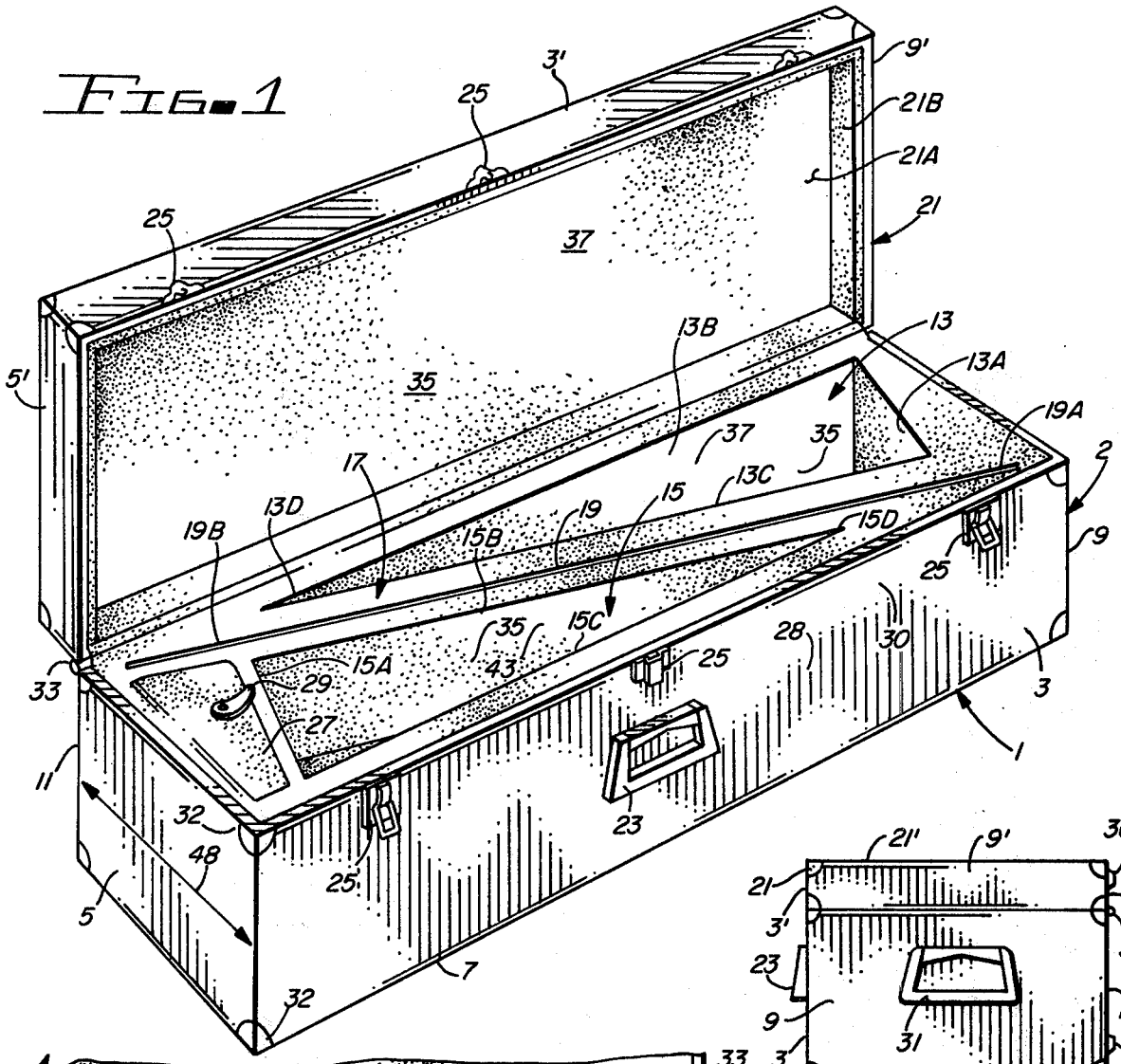
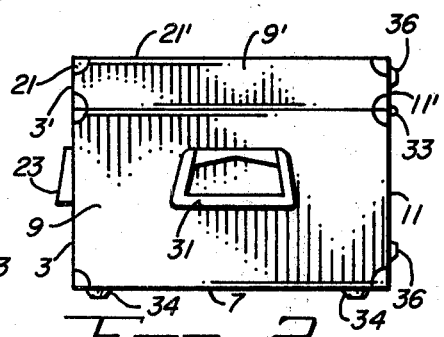
FIG. 2
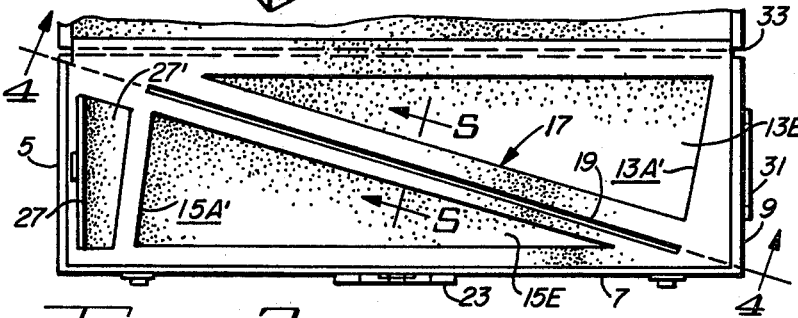
FIG. 3
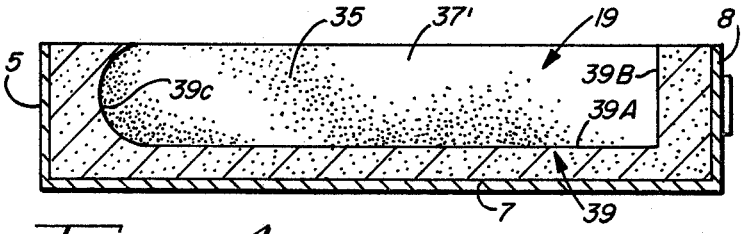
FIG. 4
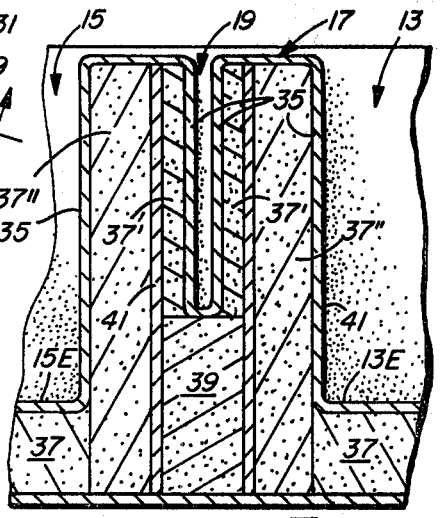
FIG. 5

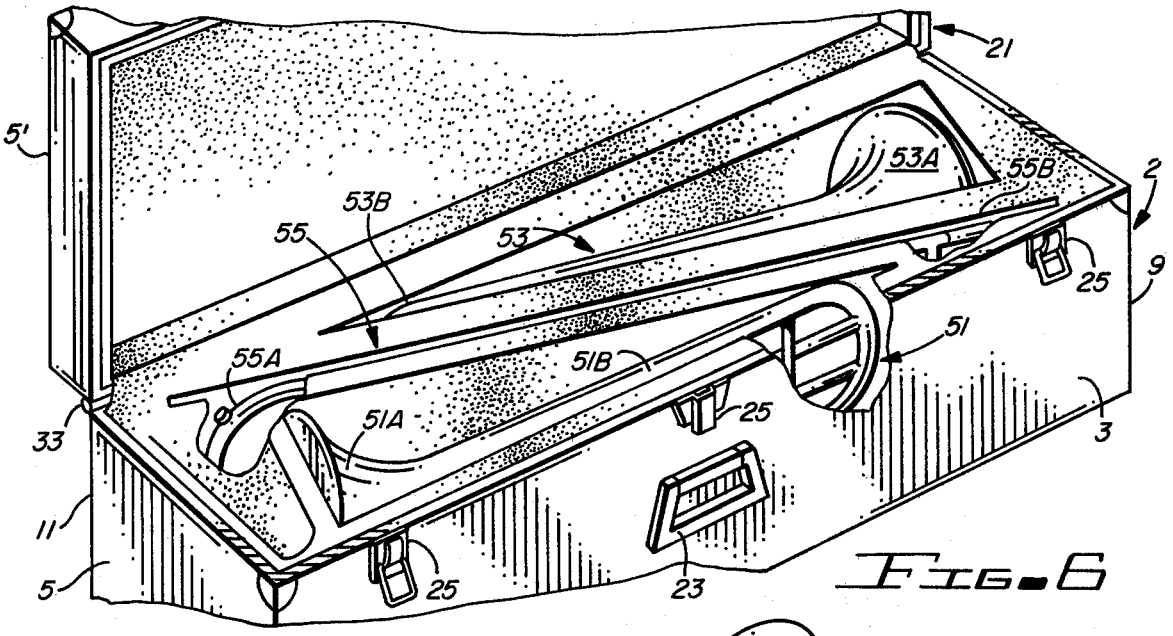
FIG. 6
FIG. 7
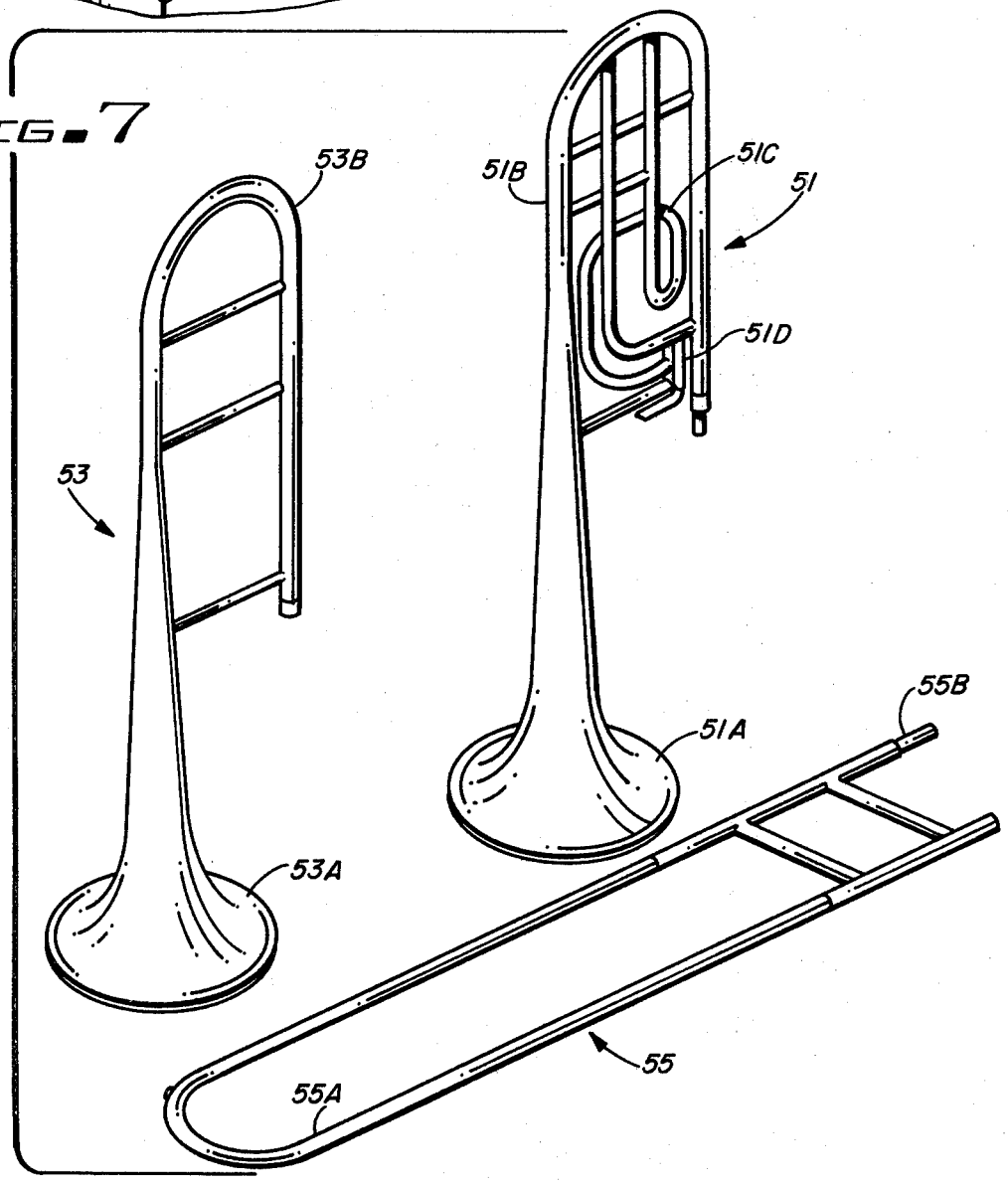

COMPACT DUAL BELL SECTION TROMBONE CASE

BACKGROUND OF THE INVENTION

The invention relates to trombone cases, and more particularly to a compact trombone case that enables a trombonist to carry the trombone components needed to enable him to play either a "single" B-flat trombone or a trombone with F attachment in a unitary case that is not substantially larger than many studio cases designed for only one trombone.

By way of background, professional trombone players often need to play two different "types" of tenor trombones. The first type of trombone includes a slide section and a "single" B-flat bell section. The second type of trombone includes an identical slide section and a B-flat bell section with F attachment. Trombone manufacturers ordinarily do not sell "single" B-flat bell sections and bell sections with F attachment individually, although both types of trombones of a particular model usually have identical slide sections.

Usually, a professional trombonist does not know in advance which type of instrument (i.e., "single" or with F attachment) he will need to play when he appears to perform for a particular engagement. Therefore, he may choose to carry two complete trombones, each in its own separate case. Most standard trombone cases are rather large and bulky. It is a great inconvenience to a trombone player to have to carry two such cases. Although various multiple compartment cases for musical instruments are known, as indicated in U.S. Pat. Nos. 1,188,927; 1,988,718; 2,792,932; and 3,048,262, no suitable case has been proposed which provides any solution whatever to the above-described problem of professional trombone players. Another problem with conventional trombone cases is that condensed water normally collects in the slide section, and frequently some of it drains from the open ends of the slide section into the interior of the case.

It is clear that there remains an unmet need for a single compact trombone case capable of carrying all of the trombone components required by a professional trombonist to enable him to perform on either a "single" or F attachment trombone. There is also an unmet need for a trombone case that alleviates some of the other irritations that professional trombone players endure, such as spillage of condensed water into the interior of standard trombone cases.

Accordingly, it is an object of the invention to provide a single compact trombone case capable of carrying all of the trombone components necessary to enable a trombonist to perform with either a "single" or an F attachment trombone.

It is another object of the invention to provide a trombone case which avoids the problem of spillage of water that has collected in the slide section.

SUMMARY OF THE INVENTION

Briefly described, and in accordance with one embodiment thereof, the invention provides an improved trombone case for carrying a first trombone bell section, a second trombone bell section, and a slide section that mates with either of the bell sections, wherein a substantially triangular first compartment holds the first bell section, a substantially triangular second compartment holds the second bell section, and at least one elongated padded slot holds the slide section; the two triangular compartments and the elongated slot have outer walls that, in combination, define a parallelepiped. In the described embodiment of the invention, the first bell section is a "single" B-flat bell section, and the second bell section is a B-flat bell section with F attachment. The elongated padded slot is disposed in a wall section that divides the first and second triangular compartments. With a cover of the trombone case raised and the first and second triangular compartments having their interiors exposed so that their bottoms are parallel to a horizontal support surface on which the trombone case rests, the wall section is vertical. When the lid is closed and the trombone case is rotated 90°, the wall section is inclined and the elongated slide section is positioned in the elongated padded slot so that its openings are elevated, preventing leakage of condensed water into the interior of the trombone case. A first handle is attached to the upper face of the trombone case as it rests in the position with the elongated padded groove so inclined. The entire interior surface of each of the first and second compartments is padded with resilient foam material that is covered with soft velvet-like material. The interior surface of the cover also is lined with resilient foam material that is covered with velvet material. The walls of elongated padded slot also are lined with resilient foam material that is covered with velvet material, so that the resilient foam material causes the slide section to be securely supported in the elongated padded slot. The resilient foam material lining the first and second compartments engages the first and second bell sections, respectively, to securely support them in the first and second compartments when the cover is closed. In the described embodiment of the invention, a second handle is positioned on an outer end surface of the trombone case so that when the trombone case is carried by the second handle, the ends of the elongated slide section remain elevated. Two sets of foot pads are provided on the outer surfaces on which the trombone case rests.

BRIEF DESCRIPTION OF THE DRAWINGS

FIG. 1 is a perspective view of the trombone case of the present invention with the cover opened to expose two triangular bell section compartments and an elongated padded slot for receiving a trombone slide section.

FIG. 2 is an elevation view of the right end of the trombone case of FIG. 1.

FIG. 3 is a top view of the trombone case of FIG. 1.

FIG. 4 is a section view taken along section line 4—4 of FIG. 3.

FIG. 5 is a section view taken along section line 5—5 of FIG. 3.

FIG. 6 is a perspective view of the trombone case of FIG. 1 holding a "single" B-flat bell section, a bell section with an F attachment, and a slide section.

FIG. 7 is an elevation view illustrating the "single" B-flat bell section, the bell section with an F attachment, and the slide section shown in the trombone case of FIG. 6.

DESCRIPTION OF THE INVENTION

Referring now to the drawings, particularly FIGS. 1–5, trombone case 1 includes a body section 12 and a cover section 21 that is connected by means of hinge 33 to body 2. Body 2 includes a face 3 that will hereinafter be referred to as front face 3. (It should be recognized that if case 1 is turned 90° so that face 3 is horizontal, face 3 will nevertheless be referred to as front face 3). For convenience, the surfaces of case 1 will be defined as bottom, top, front, back, and end faces with reference to their orientation as shown in FIG. 1, even though the case 1 will be re-oriented during carrying thereof.

Body 2 also includes a left end face 5, a right end face 9 (FIG. 3), a bottom face 7 (FIG. 2) and a back face 11 (FIG. 2). Cover 21 includes a top surface 21′ (FIG. 2).

A first carrying handle 23 is attached to front surface 3, and a second carrying handle 31 is attached to right end surface 9. The position of handle 23 is selected so that when cover 21 is closed, handle 23 is centrally positioned on the "entire" surface consisting of surface 3 of body 2 and surface 3′ of cover 21. Similarly, handle 31 is positioned so that when cover 21 is closed, the location of handle 31 is essentially central with respect to the "entire" surface consisting of right end surface 9 and right end surface 9′ of cover 21.

In the interior of trombone case 1 there are two generally triangular compartments 13 and 15 separated by a diagonal wall 17. A padded elongated slot 19 is provided in diagonal wall section 17. An accessory compartment 27′ (FIG. 3) with a hinged cover 27 (FIG. 1) is also provided.

At this point, it will be helpful to refer to FIG. 7 for a more detailed description of the trombone components to be carried in case 1. In FIG. 6, reference numeral 55 designates a slide section of a trombone. It has a curved end portion 55A and a bell section receiver end portion 55B which engages a bell section. Reference numeral 53 designates a standard B-flat trombone bell section, also commonly referred to as a "single" bell section. Reference numeral 51 designates a bell section that is very similar to bell section 53, except that bell section 51 includes an attachment 51C referred to as an F attachment with a valve 51D referred to as a rotary valve. Slide section 55 mates with either of bell sections 51 or 53, as is ordinarily the case for corresponding model trombones made by a particular manufacturer.

The F attachment bell section 15 includes F attachment 51C, which includes approximately three additional feet of tubing. This, in addition to rotary valve 51D, enables a trombone player to avoid long shifts of slide 55 between the "first position" and "sixth" or "seventh" positions of the slide during playing of the trombone. A trombone bell section with an F attachment is slightly wider than a standard "single" B-flat trombone bell section.

The provision of the F attachment with rotary valve not only reduces the number of long slide shifts trombonists have to make, but also results in addition of low frequency notes that are sometimes required.

In accordance with the present invention, compartment 13 is generally triangular in configuration, as best seen in FIG. 1 and FIG. 3. Its dimensions are selected so that the bell section with the F attachment, namely bell section 51, fits securely into compartment 13. The dimensions of compartment 15, which is also triangular in configuration, is such that standard "single" bell section 53 fits securely therein. Since a bell section with F attachment is slightly wider than a "single" bell section, the distance from point 13D to wall 13A of compartment 13 is greater (by two inches) than the distance from point 15D to wall 15A of compartment 15.

Partition 17 forms a dividing wall between triangular compartments 13 and 15. As can be seen in FIG. 7, each of the bell sections has an enlarged "horn end" that extends from a tubular section. The dimensions of end wall 13A of compartment 13 are chosen so that horn end 51A fits snugly into the base portion of compartment 13, and the perimeter of horn end 51A deforms the polyurethane foam (subsequently described) with which all wall surfaces of compartments 13 and 15 and the walls of slot 19 are lined. The tube end 51B of bell section 51 fits between the resilient lined walls adjacent to point 13D of compartment 13. Similarly, the dimensions of end wall 15A or compartment 15 receive the horn shaped end 53A of bell section 53 of FIG. 7, and the tube end 53B of bell section 53 snugly fits between the foam-lined walls adjacent to end portion 15D of compartment 15.

As indicated above, walls 13A, 13B and 13C of compartment 13 are all lined with ¾ inch resilient thick polyurethane foam, generally designated by reference numeral 37. The polyurethane foam is covered with velvet-like liner material 35, as is common in musical instrument cases. Bottom surfaces 13E of compartment 13 and 15E of compartment 15 (FIG. 3) also are lined with ¾ inch polyurethane foam covered with velvet-like liner material. The inner surface 21A of cover section 21 also is lined with ¾ inch thick polyurethane foam 37 covered with velvet liner fabric 35.

Preferably, the entire outer surface of case 13 is covered with vinyl material, designated by reference numeral 28. The outer sides, ends, bottom, and top of case are constructed of ¼-⅜ inch plywood, designated by reference numeral 30. Metal corner hardware elements such as those designated by reference numeral 32 are provided on all of the corners of trombone case 1. Hardware elements, such as those designated by reference numeral 25 are provided to accomplish effective closing and locking of cover 21. Rubber pads or feet such as those designated by reference numeral 34 are installed on bottom surface 7, as best seen in FIG. 2. Corresponding rubber pads or feet 36 are installed on back surfaces 11 and 11′, as shown in FIG. 2.

Thus, after the slide section 55, bell section 51, and bell section 53 have been positioned in their appropriate compartments and cover 21 has been closed and locked, trombone case 1 can be rotated 90° so that it rests on back surface 11, pads 36 supporting the weight on a horizontal surface (not shown). When trombone case 1 is so positioned, it is noteworthy that elongated padded slot 19 and partition 17 are inclined with right end 19A elevated relative to left end 19B.

Next, the construction of wall section 17 is described in further detail with reference to FIGS. 4 and 5. In FIG. 4, which is a section view along section line 4—4 of FIG. 3, it can be seen that slot 19 has an elongated, generally flat bottom surface 39A, a generally straight right end surface 39B, and an arcuate left end surface 39C. The vertical walls of slot 19 are lined with ¼ inch polyurethane foam 37 covered with velvet liner material 35. (Note that reference numeral 37 is used throughout the drawings to represent polyurethane foam material which has been exposed in the partial cutaway view shown in FIGS. 1–5; similarly, reference numeral 35 is used throughout to designate the velvet liner surface material).

In FIG. 4, reference numeral 39 designates a ¾ inch thick styrofoam "board" having a cutaway section which forms slot 19. Referring to FIG. 5, reference numerals 41 designate two one-eighth inch thick panels of chipboard or similar rigid material. Reference numeral 37′ designates two ¼ inch thick slabs of polyurethane foam that are glued to the respective inner faces of chipboard panels 41. The lower face portions of polyurethane foam slabs 37' are glued to the outer surface of chipboard 41 (FIG. 5). The outer faces of chipboard panels 41 are glued to two respective ¾ inch thick slabs 37" of polyurethane foam. Reference numeral 35 in FIG. 5 designates the velvet lining material that is everywhere attached to the outer surfaces of the polyurethane foam slabs 37' and 37".

Accessory compartment 27' (FIG. 3) is provided adjacent to base end portion 15A of triangular compartment 15 because triangular compartment 15 is somewhat shorter than triangular compartment 13, allowing more space for compartment 27'. A flexible tab 29 is attached to compartment cover 27, which is hingeably connected to the upper edge of left end section 5.

The above-mentioned outer vinyl covering 28, the velvet lining material 35, and the hardware trim items all can be obtained from Custom Case Supply Company, of Woodland Hills California. the velvet-like material is referred to by this supplier as "crush plush" material.

In the described embodiment of the invention, the height of body section 2, as shown in FIG. 1 of trombone case is 7-¼ inches, the height of cover 21 being 2-¼ inches, thereby making the total height 9-½ inches. The width (designated by line 48 in FIG. 1) is 12-½ inches, and the length of 33-¾ inches. The distance between base portion 13A and point 13D of compartment 13 is 32-½ inches. The corresponding dimension of compartment 15 is 30-½ inches. The length of the line designated by reference numeral 13A' in FIG. 3 is 10 inches, and the length of the line designated by reference numeral 15A' in FIG. 3 is 9-½ inches. The foregoing dimensions are for a case for a symphonic size trombone. For smaller trombones, most of the foregoing dimensions are one inch less than given above.

FIG. 6 clearly illustrate how bell section 51 and 53 fit in the trinangular compartments, respectively, and how slide section 55 fits into elongated padded slot 19, the curved end 55A of slide section 55 being positioned adjacent to arcuate end portion 39C of groove 19 (FIG. 4), so that bell section receiver end 55B is positioned in the right end 19A of slot 19 (FIG. 1). This ensures that when trombone case 1 with the above-mentioned trombone components therein as shown in FIG. 6 has its cover 21 closed and secured, and then is turned 90° so that surface 3 is horizontal, then the open ends of slide 55 are elevated, so that any condensed water therein does not drain out into the interior of case 1. Similarly, if trombone case 1 is then lifted by end handle 31 (for example, to carry trombone case 1 in an elevator), the open ends of slide section 55 remain elevated, and no leakage of water into the interior of the case 1 can occur.

Trombone case 1 is as short as, and perhaps is shorter than, most conventional trombone cases that are designed for carrying a slide section and a single bell section. The symmetrical positioning of triangular compartments 13 and 15 on opposite sides of wall 17, so that the outer walls of the two compartments generally outline a parallelepiped, results in a width that is scarcely greater than that of conventional single trombone cases. Yet, since the musician can, is essence, carry two trombones, namely a "single" trombone and an F attachment trombone within single case 1, he avoids the necessity of carrying two separate prior art bulky trombone cases, each of which is nearly as large as, or even larger than trombone case 1. All of the necessary accessories can be carried in accessory compartment 27', including mouthpiece, a mouthpiece brush, a small spray bottle of water to lubricate the slide, and a small container of slide cream, which is also used for lubricating the slide.

Despite their large sizes, many conventional single trombone cases do not contain much useble extra space. However, if a musician desires to use trombone case 1 to carry only a unitary bell section, he can use the other triangular compartment to carry two mutes, such as a straight mute and a practice mute. This is often very handy to the trombonist, since then he does not need to carry the mutes in a separate container.

Another advantage of the trombone case shown in FIG. 1 is that the symmetrical positioning of compartments 13 and 15 results in very uniform weight distribution with reference to handle 23, regardless of whether case 1 is empty or is loaded with two bell sections, since the horn-shaped ends of the two bell sections are at opposite ends of the case.

While the invention has been described with reference to a particular embodiment thereof, those skilled in the art will be able to make various modifications to the described embodiment of the invention without departing from the true spirit and scope thereof. It is intended that the invention encompass all substantial equivalents of the invention that accomplish substantially the same thing in substantially the same way to obtain substantially the same result. For example, the elongated padded slot 19 could be provided adjacent to and parallel to front wall 3, instead of in wall section 17. This, however, would result in the loss of the advantage of preventing spillage of water out of the open ends of slide section 55. Although the triangular compartments 13 and 15 have been shown as truly triangular they could, of course, be modified so that their interior surfaces conform closely to the actual shape of the two bell sections without departing from the true spirit and scope of the present invention. Furthermore, the two compartments 13 and 15 could actually be defined by several thin baffles with cutaway sections that contact and support the bell sections, rather than being defined by continuous foam padded walls. It is intended that the compartments 13 and 15 can be defined in this manner also. Furthermore, a second elongated slot parallel to slot 19 could be provided in wall section 17 to hold a second slide section. In this event, the trombonist can carry two complete trombones, including a B-flat trombone (either "single" or with F attachment) and an E-flat or F alto trombone).

I claim:

1. A trombone case comprising in combination:

a body section including first and second padded generally triangular compartments for storing first and second bell sections, respectively, a base end portion of said first generally triangular compartment receiving and snugly engaging an enlarged flared horn end portion of said first bell section, a generally pointed end portion of said first generally triangular compartment receiving and snugly engaging a narrowed tubular portion of said first bell section opposite to the enlarged flared horn portion thereof, a base end portion of said second generally triangular compartment receiving and snugly engaging an enlarged flared portion of said second bell section, and a generally pointed end portion of said second generally triangular compartment receiving and snugly engaging a narrowed tubular portion of said second bell section opposite to the enlarged flared horn portion thereof, the base end portion of said first generally triangular compartment being adjacent to the pointed end portion of said second generally triangular compartment, and the base end portion of said second generally triangular compartment being adjacent to the pointed end portion of said first generally triangular compartment so that outer walls of said first and second generally triangular compartments approximately coincide with the sides of a parallelepiped, the distance between a front wall and a rear wall of said trombone case being substantially less than twice the width of the base end portion of either of said first and second generally triangular compartments;

a well section bounding at least one of said first and second generally triangular compartments, said wall section having an elongated padded groove therein for receiving and snugly engaging a slide section which mates with either of said first and second bell sections, wherein said wall section having said elongated padded groove therein is diagonally disposed between said first and second generally triangular compartments and serves as a wall for each of said first and second generally triangular compartments; and a cover section closeable on said body section to enclose said first and second generally triangular compartments, said cover section having a padded interior surface.

2. The trombone case of claim 1 wherein the exterior of said trombone case, when said cover section is closed, has the general configuration of a rectangular parallelepiped, and wherein said body section includes a first panel that serves as a bottom of said first and second generally triangular compartments and as a bottom of said trombone case when said trombone case rests on a horizontal surface, said wall section having said elongated padded groove therein being substantially perpendicular to said first panel.

3. The trombone case of claim 2 including second, third, fourth and fifth panels which, respectively, serve as front, back, and end walls of said trombone case when said trombone case rests on said horizontal surface as recited in claim 2, said cover section being hinged to said third panel.

4. The trombone case of claim 3 wherein said wall section having an elongated padded groove therein includes a center panel with an elongated cutaway portion and resiliently padded panels attached to the opposed major surfaces of said wall section to form said padded groove in the region bounded by said cutaway portion.

5. The trombone case of claim 4 including a first handle attached to the outer surface of said second panel so that when said cover section is closed and said trombone case is rested on a horizontal surface so that said third panel rests on said horizontal surface said first handle is on the top surface of said trombone case and said wall section having said elongated padded groove therein is inclined relative to the horizontal surface whereby the slide section is held in said elongated padded groove so that its open ends are relatively elevated in order to prevent leakage of water into the interior of said trombone case and said handle is positioned to facilitate convenient carrying of said trombone case.

6. The trombone case of claim 5 including a relatively small accessory compartment between the base portion of said first generally triangular compartment and said fourth panel, said first generally triangular compartment being partly bounded by said second panel and said second generally triangular compartment being partly bonded by said third panel.

7. The trombone case of claim 6 wherein the walls and bottoms of said first and second generally triangular compartments are padded with resilient foam material and are lined with velvet-like material and the inside surface of said cover section is padded with resilient foam material and lined with velvet-like material.

8. The trombone case of claim 7 wherein said elongated padded groove is padded with resilient foam material and lined with said velvet-like material.

9. The trombone case of claim 8 including a second handle attached to the outer surface of the one of said fourth and fifth panels opposite to said accessory compartment, whereby said trombone case with said slide section held in said elongated padded groove can be carried by either said first handle or said second handle without danger of water spillage from the open ends of said slide section into the interior of said trombone case.

10. The trombone case of claim 1 wherein said first bell section is a "single" B-flat bell section and said second bell section is a B-flat bell section with an F attachment.

11. A trombone instrument and case assembly comprising in combination:

a body section including first and second padded generally triangular compartments;

first and second bell sections stored, respectively, in said first and second generally triangular compartments;

a base end portion of said first generally triangular bell section receiving and snugly engaging an enlarged flared horn portion of said first bell section, a generally pointed end portion of said first generally triangular compartment receiving and snugly engaging a narrowed tubular portion of said first bell section opposite to the enlarged flared horn portion thereof, a base end portion of said second generally triangular bell section receiving and snugly engaging an enlarged flared horn portion of said second bell section, and a generally triangular compartment receiving and snugly engaging a narrowed tubular portion of said second bell section opposite to the enlarged flared horn portion thereof, the base end portion of said first generally triangular compartment being adjacent to the pointed end portion of said second generally triangular compartment, and the base end portion of said second generally triangular compartment being adjacent to the pointed end portion of said first generally triangular compartment so that outer walls of said first and second generally triangular compartments approximately coincide with the sides of a parallelepiped, the distance between a front wall and a rear wall of said trombone case being substantially less than twice the width of the base end portion of either of said first and second generally triangular compartments, a wall section bounding at least one of said first and second generally triangular compartments, said wall section having an elongated padded groove therein, wherein said wall section having said elongated padded groove therein is diagonally disposed between said first and second generally triangular compartments and serves as a wall for each of said first and second generally triangular compartments;

a slide section which mates with either of said first and second bell sections stored in said elongated padded groove; and a cover section closeable on said body section to enclose said first and second generally triangular compartments, said cover section having a padded interior surface.

12. The trombone instrument and case assembly of claim 11 wherein said first bell section is a "single" B-flat bell section and said second bell section is a B-flat bell section with an F attachment, whereby a trombonist can carry the components necessary to enable him to play either standard trombone music or trombone music wherein a bell section with an F attachment is required within a single conveniently sized case, thereby avoiding the need to carry two separate trombones in separate respective cases.

* * * * *